United States Patent [19]

Woodley

[11] 4,052,949

[45] Oct. 11, 1977

[54] METHOD FOR MAKING EASY OPEN CONTAINER END WITH PROTECTIVE EDGES FOR ITS SEVERED SCORE

[75] Inventor: Keith R. Woodley, San Francisco, Calif.

[73] Assignee: Wescan, Inc., San Francisco, Calif.

[21] Appl. No.: 755,746

[22] Filed: Dec. 30, 1976

Related U.S. Application Data

[62] Division of Ser. No. 698,093, June 21, 1976, Pat. No. 4,017,000.

[51] Int. Cl.[2] ..... B21D 51/44

[52] U.S. Cl. ..... 113/121 C; 113/15 A

[58] Field of Search ..... 113/121 C, 15 R, 15 A; 220/266, 270, 90.6

[56] References Cited

U.S. PATENT DOCUMENTS

| | | | |
|---|---|---|---|
| 3,696,961 | 10/1972 | Holk | 220/90.6 |
| 3,765,352 | 10/1973 | Schubert et al. | 113/121 C |
| 3,853,080 | 12/1974 | Zundel | 113/121 C |
| 3,868,919 | 3/1975 | Schrecker et al. | 113/121 C |
| 3,939,787 | 2/1976 | Morrison et al. | 113/121 C |
| 3,945,334 | 3/1976 | Ostrem et al. | 113/121 C |
| 3,986,631 | 10/1976 | Ostrem | 220/270 |
| 3,990,376 | 11/1976 | Schubert et al. | 113/121 C |

*Primary Examiner*—Michael J. Keenan

[57] ABSTRACT

An easy open container end having a pair of generally annular double-reverse folds with a common scored band between them that defines a removable panel wherein a smooth edge of each of the double-reverse folds protects the severed edge of the score upon removal of the panel from the container and a method for forming the improved easy open container end.

2 Claims, 16 Drawing Figures

METHOD FOR MAKING EASY OPEN CONTAINER END WITH PROTECTIVE EDGES FOR ITS SEVERED SCORE

This application is a division of U.S. patent application Ser. No. 698,093 filed June 21, 1976, now U.S. Pat. No. 4,017,000.

BACKGROUND OF THE INVENTION

Upon removal of a tear portion or panel from an easy open container end the torn score line normally leaves a sharp edge both on the removed tear portion or panel and upon the part of the end that remains attached to the container. These sharp edges are dangerous cutting edges to the consumer who is not careful in handling either the opened container or the removed tear portion or panel. The problem is particularly acute in the so called full-panel pull-out in which the removed panel covers a major area of the container end.

Partial solutions to the problem are described in U.S. Pat. No. 3,939,787 issued Feb. 24, 1976 to John Morrison et al. entitled "Convenience Closure with Safe Edges," in U.S. Pat. No. 3,765,352 issued Oct. 16, 1973 to James R. Shubert et al. entitled "Combined Can and End with Means for Protecting Against Severed Score" and in U.S. Pat. No. 3,696,961 issued Oct. 10, 1972 to Elbert J. Holk, Jr., entitled "Protective Edge for Easy Opening Container," particularly FIGS. 10 and 11.

SUMMARY OF THE INVENTION

The present invention protects the severed edges of a full-panel pull-out and is an improvement upon the disclosures in the patents cited above. The improved container end includes a pair of double-reverse folds with a common band between them. A score line in the band defines a removable panel which carries the inner one of the double-reverse folds with a smooth protective edge underlying the severed score line. The outer one of the double-reverse folds has a smooth protective edge overlaping the score line along its periphery except in a very small region wherein a lifting tab fracturing nose normally spans the score line. The outer double-reverse fold connects the chuck wall of the end and in that region is flattened outwardly and upwardly to provide clearance for the fracturing nose of the lifting tab and protection against accidental rupture of the score line, for example, by the seaming chuck at the time the improved end is seamed upon the container sidewall.

The protective edges of the pair of double-reverse folds are multiple thicknesses of the sheet material from which the end is made and each is located to protect one severed edge of the score so as to provide the consumer protection generally described in the foregoing U.S. Pat. Nos. 3,765,352, 3,696,961 and 3,939,787.

A principal object of the improved end of this invention is elimination of the annular rib in the container sidewall which is necessary to protect one edge of the severed score line in the container and disclosed in U.S. Pat. No. 3,765,352, particularly FIG. 2. That rib is hard to form to full depth, weakens the container from a vertical strength standpoint and tends to stretch and break any internal container coating and, in a three-piece container, the rib imperils side-seam integrity.

Another object of the improved container end of this invention is use on other than metal containers, such as paper, or fiber or plastic, where formation on the protective annular rib is difficult.

A further object of the improved container end of this invention is provision by the outer double-reverse fold of resiliency near the score line which helps keep the score line from rupturing during the double seaming of the end upon the container sidewall.

Still another advantage of the improved container end of this invention is to enable use of a stronger seaming chuck during the seaming operation.

Another advantage of the improved container end also is that it may be stacked with other similar ends with less likelihood of scoreline fracture because the upwardly flattened outer double-reverse fold at the lifting tab prevents depression of the fracturing nose by the overlying stacked container ends.

A further advantage of the improved end of this invention is the implosion resistance provided by the resiliency or spring in the annular double-reverse folds so that there is no release of score-lined tension. So, too, the outer double-reverse fold provides strength along the chuck wall which minimizes chuck wall reversal and permits thinner gauge material to be used in the container end construction.

Other objects and advantages of the improved container end of this invention will be apparent upon consideration of the following description and accompanying drawings wherein:

DESCRIPTION OF THE PREFERRED EMBODIMENT OF EASY OPEN CONTAINER END

Figure 3:
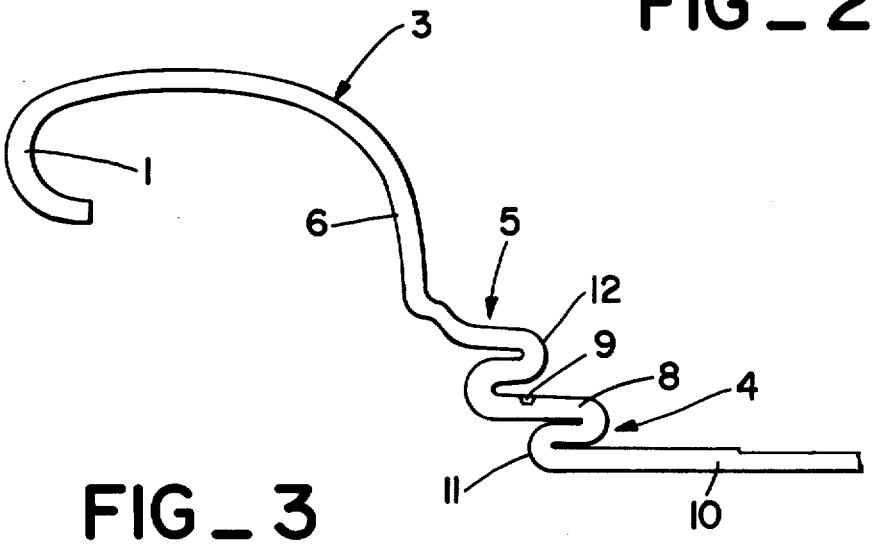
FIG. 3 is a sectional view of the container end taken along line 3—3 of FIG. 1 to illustrate the double-reverse folds of the can end in all regions other than at the lifting tab fracturing nose wherein the cross-hatching also is omitted for clarity.
Figure 4:
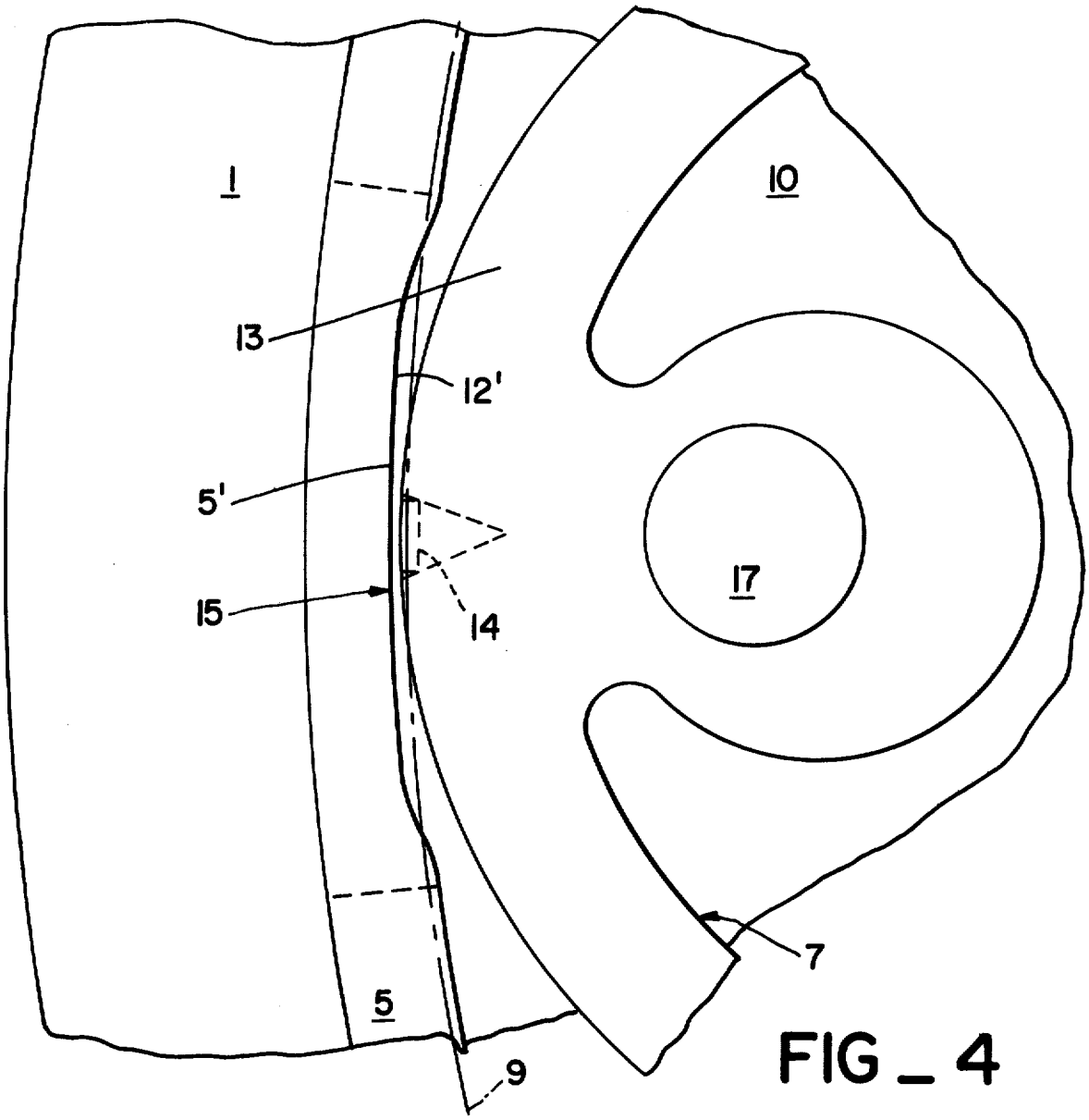
FIG. 4 is an enlarged plan view of the container end of FIG. 1 in the region of the lifting tab fracturing nose.
Figure 5:
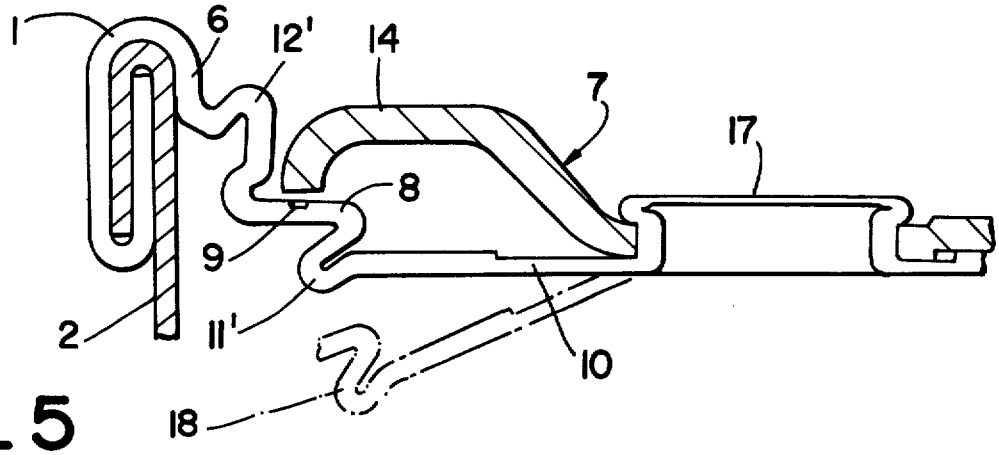
FIG. 5 is a sectional view of the container end of this invention shown seamed upon a container sidewall in the region of the lifting tab fracturing nose again with the cross-hatching omitted for clarity.

FIGS. 1–5 illustrate the improved easy opening container end and its placement upon the sidewall of a container. The end includes a curled edge 1 for seaming upon the open end of the container side wall 2 as shown in FIG. 5. In the described embodiment the container end is for a cylindrical container or can and accordingly the curled edge is generally annular in shape. It, of course, may have other configurations for other shaped containers. The end wall, referred to generally as 3, has formed therein a pair of double-reverse folds. The inner one is designated 4 and the outer one is designated 5.

A chuck wall 6 connects the curled edge 1 to the outer one of the double-reverse folds 5. A pull tab or lifting tab 7, for example, of the type illustrated in U.S. Pat. No. 3,765,352 is secured to the end wall 3.

In the described embodiment the double-reverse folds 4, 5 are also annular in shape, and are interconnected by a common band 8 of sheet material in which is formed a score line 9. The score line 9 defines a removable panel 10 in the container end wall 3 which carries the inner double-reverse fold 4 upon severance of the panel from the remainder of the end. Upon severance of the removable panel 10 the outer double-reverse fold 5 remains integral with the chuckwall 6. As is illustrated in FIG. 3, the smooth edge 11 of the inwardly opening fold of the inner double-reverse fold 4 is located underneath the score line 9 and upon its fracture protects the severed score edge on the removable panel 10. The smooth edge 12 of the outwardly opening fold of the outer double-reverse fold 5 is located over the score line 9 and upon its fracture protects the severed score edge that remains integral with the chuck wall and double-reverse fold 5.

Figure 2:
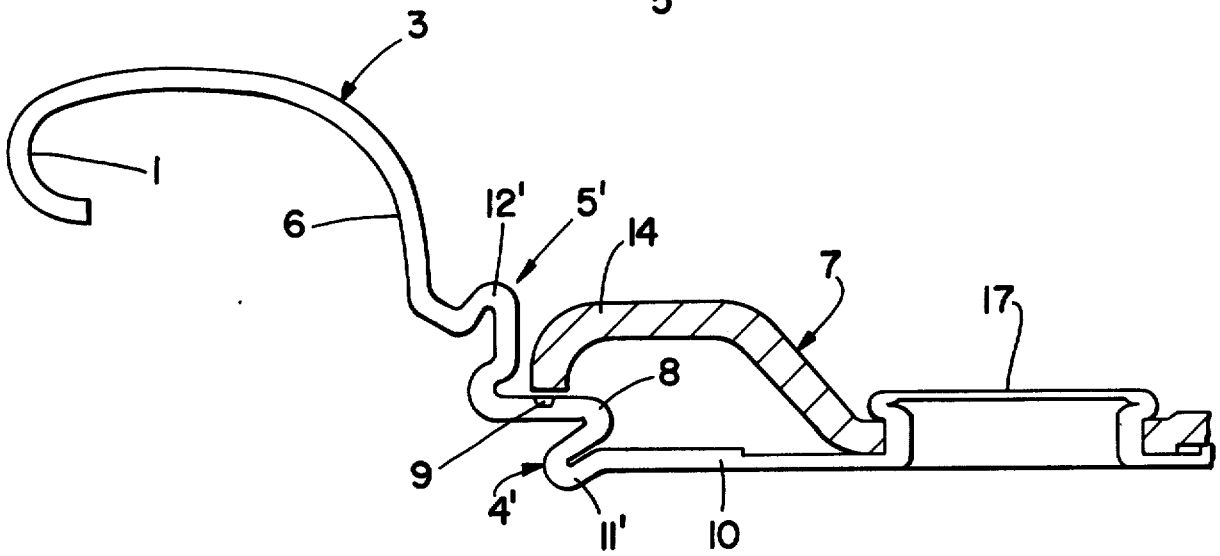
FIG. 2 is a sectional view taken along line 2—2 of FIG. 1 to illustrate the relationship of the annular double-reverse folds in the region of the lifting tab fracturing nose wherein the section cross-hatching is omitted for clarity of illustration.

However, in the region of the lifting tab 7 the outer double-reverse fold 5′ is flattened outwardly and upwardly as at 12′ in FIG. 2 so as to proivde clearance for the end 13 of the lifting tab 7 which carries fracturing nose 14 only in a flattened region of tne nose as is indicated more clearly on FIG. 4 at 15.

As is more particularly described in U.S. Pat. Nos. 3,765,352, 3,850,124 and 3,837,524 the illustrated lifting tab 7 is secured to the removable panel 10 by an integral rivet 17 located on the panel so that the thickness of fracturing nose 14 spans the score line 9 and just clears the protective smooth edge 12′ of the outer double-reverse fold 5′. For example, a typical fracturing nose thickness is 0.018–0.020 inch centered upon the centerline of the score line as shown in FIG. 4 with about 0.005–0.010 inch clearance between the outside end of the nose and outer double-reverse fold 5′. The score line at the top surface of band 8 extends about 0.0075–0.0080 to each side of the centerline of the score. In the region immediately beneath the fracturing nose 14, the inwardly opening fold 11′ of inner double-reverse fold 4′ may be bent downwardly slightly to enable easier fracturing of the score line 9 as is shown in FIG. 2.

Figure 1:
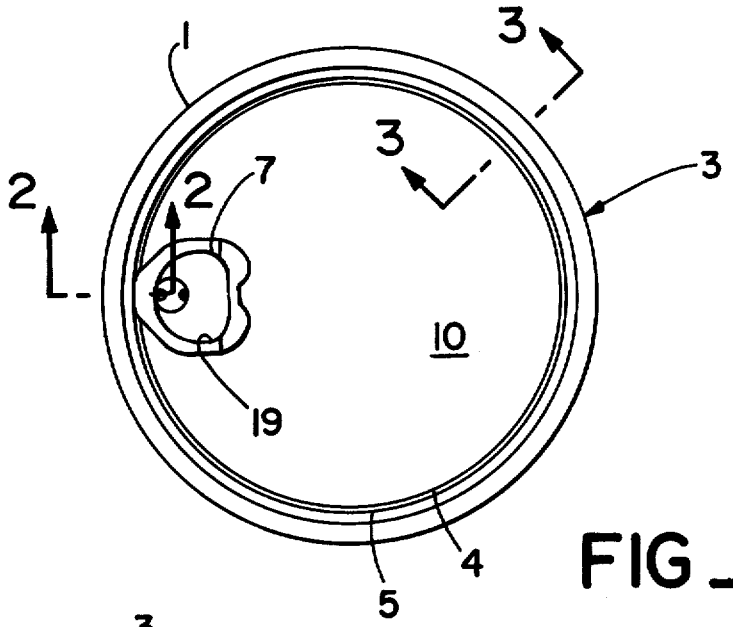
FIG. 1 is a plan view of the easy opening container end of this invention.

The other end of the lifting tab 7 has a lifting loop indicated generally as 19 in FIG. 1 and is more particularly described in U.S. Pat. Nos. 3,850,124 and 3,837,524. To open the container end 3 and remove removable panel 10 one lifts up on the lifting end 19 of the lifting tab 7. The tab acts like a lever about rivet 17 acting as a fulcrum. Raising the lifting end 19 forces the fracturing nose 14 downwardly to sever the score line 9 and bend the edge of panel 10 downwardly at 18, as is more clearly illustrated in FIG. 5 in hidden lines. Pulling of the lifting tab 7 then bends the edge of panel 10 upwardly past the flattened region 15 of the outer double-reverse fold 5′ to tear the removable panel form the end along the remainder of score line 9. The outer double-reverse fold 5 provides strength to the container end around the foot of chuck wall 6 to resist the upward pulling force and thereby to enhance the shearing ability of the score line and reduce the possibility of chuck wall reversal. This permits one to use thinner guage material in fabricating the improved end of this invention.

The smooth edge 12 of outer double-reverse fold 5 protects the consumer from cutting himself on the sharp cutting edge of the score line that remains integral with that fold and the chuck wall around the majority of the periphery of the score line by overlapping the severed edge. In the region of the lifting tab fracturing nose the substantial thickness provided by the flattened outer double-reverse fold 5′ accomplishes the same function. Similarly, the smooth edge 11 of the inner double-reverse fold 4 underlies the entire periphery of the severed edge of score line 9 on removable panel 10 and protects the consumer from its sharp cutting edge also.

As is apparent in FIG. 2 the outwardly and upwardly flattened outer double-reverse fold 5′ at 15 and 12′ protrudes slightly above the fracturing nose 14 of the lifting tab 7 and thereby protects against accidental fracturing of the score line by that flange, for example, by external pressure during seaming or by stacking of the improved container ends one upon another. The outer double-reverse fold 5 similarly protects against premature fracture elsewhere around the score line.

DESCRIPTION OF THE PREFERRED FORMING METHOD AND TOOLING

The forming operation and tooling of the improved container end of this invention are similar to those described in U.S. Pat. No. 3,765,352 with various modifications which are apparent in FIGS. 6–14. The forming operation starts by drawing a flat circular blank into the shaped configuration shown in FIG. 6 by suitable tooling. That configuration includes a partially shaped curled edge 25 similar to the peripheral attaching flange in FIGS. 2 and 4 of U.S. Pat. No. 3,765,352. The configuration also includes an annular radial section 26 and axially displaced center section 27 interconnected by a generally vertical connecting section 28 oriented approximately 17° from the vertical. The partially formed curled edge 25 is interconnected to the radial section 26 by a generally vertical wall having an upper portion 29 oriented about 4° with respect to the vertical and a lower portion 30 oriented five degrees with respect to the vertical and an interconnecting reverse locking bend 31. The locking bend 31 initiates formation of outer double-reverse fold 5 and the upper portion 29 of the wall connecting the partially formed edge curl 25 ultimately forms chuck wall 6 of the finished product.

Figure 6:
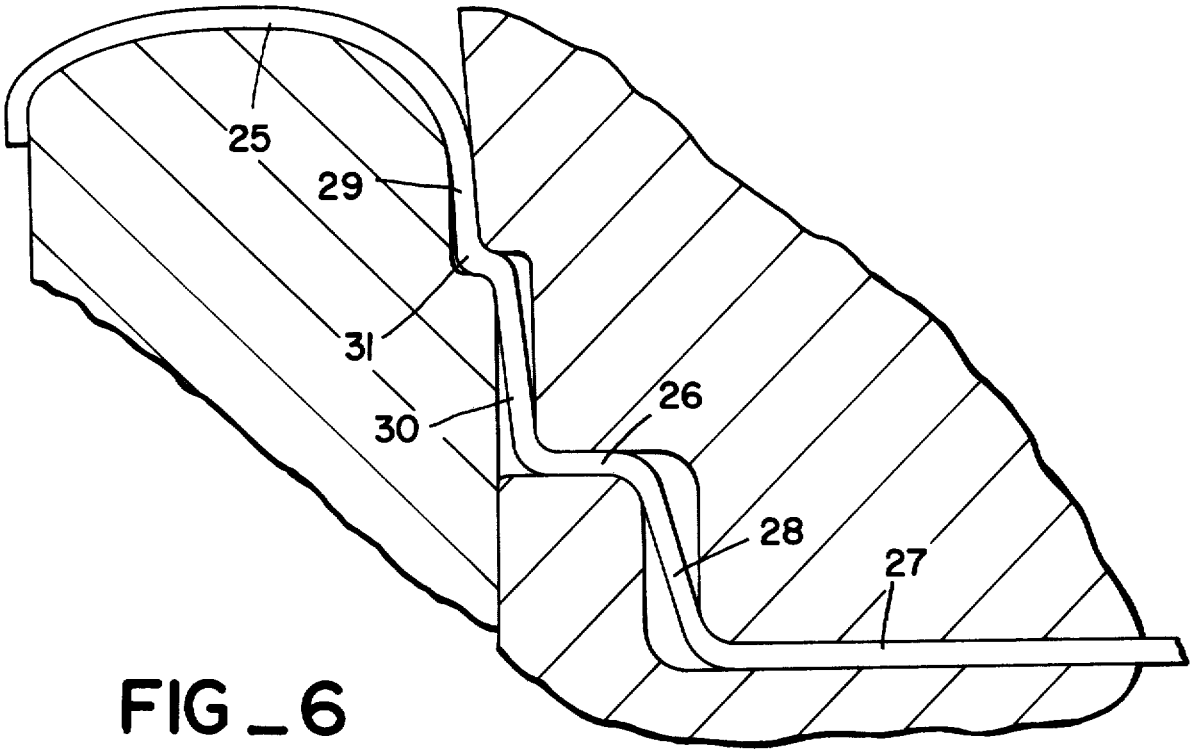
FIG. 6 is a partial sectional view of the can end of this invention after the first forming operation with only the tooling shown cross-hatched for clarity.
Figure 7:
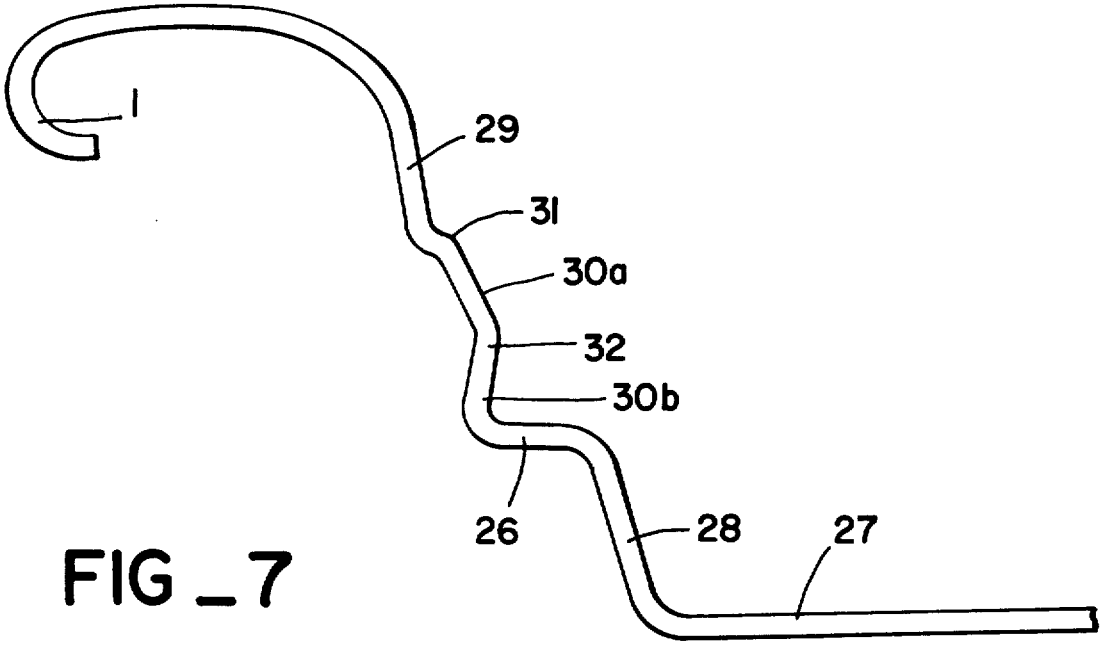
FIG. 7 is a partial sectional view of the container end of this invention following the second edge rolling step in the forming operation again with cross-hatching omitted for clarity.
Figure 9:
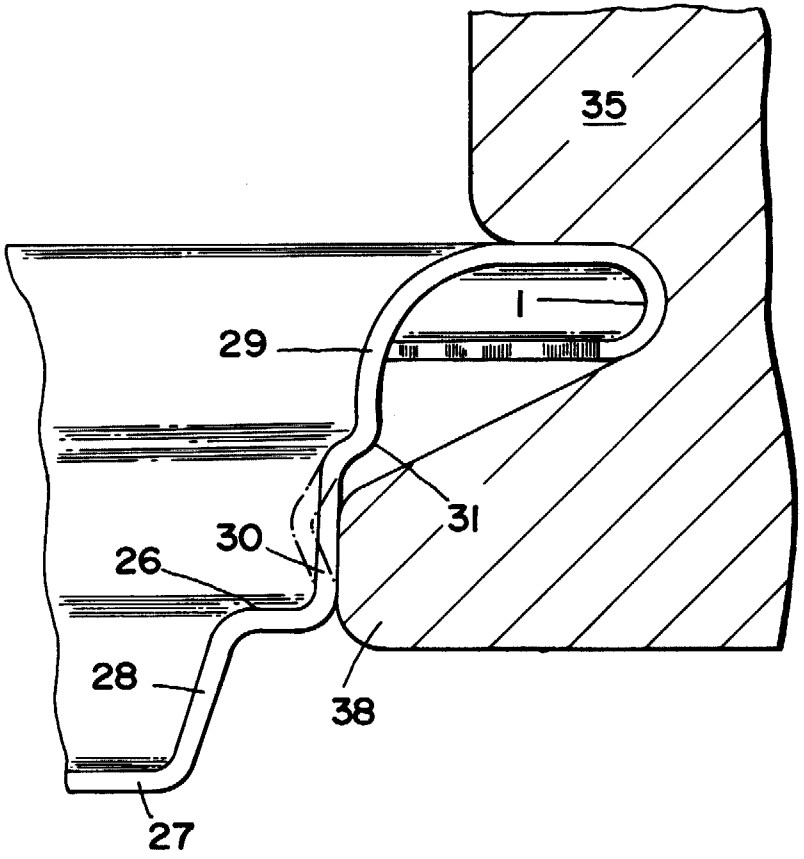
FIG. 9 is a partial sectional view of the tooling for the edge curling second step of the forming operation also with only the tooling cross-hatched.
Figure 8:
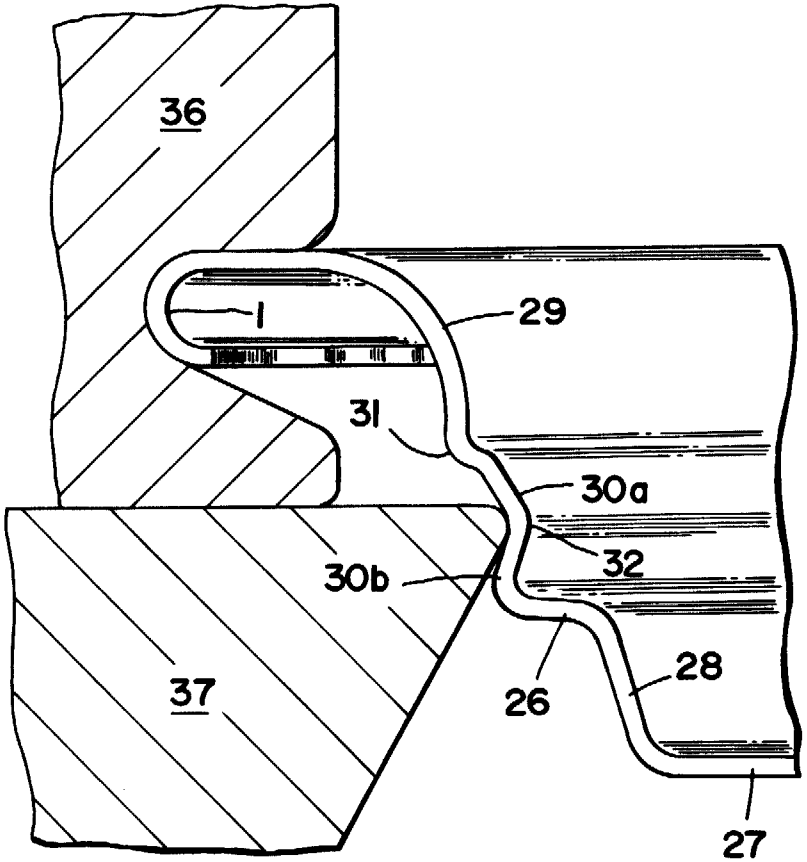
FIG. 8 is a partial sectional view of the tooling for performing the second edge rolling step in forming the container end of this invention with only the tooling cross-hatched.

In a second forming operation the partially shaped end of FIG. 6 is further formed into a configuration illustrated in FIG. 7. The partially formed curled edge 25 of FIG. 6 is shaped into its final form of edge curl 1 of the improved container end and a directional bead 32 for the outer double reverse fold 5 is formed in wall portion 30, preferably at least one thickness of the end material, into wall portions 30a and 30b shown in FIG. 7. The forming illustrated on FIG. 7 may be done on standard 270° curler tooling with a beading rail illustrated schematically in FIG. 8. The partially formed end of FIG. 6 revolves at least three times during its initial 150° of travel through the curler tooling during which the stationary curling die segment 36 and curling die wheel 35 form edge curl 1 as is shown in FIGS. 8,9. Then the end revolves at least two times during its final 120° of travel during which beading rail 37 forms bead 32. The shoulder 38 on curling die wheel 35 provides support for the end at wall portion 30 to assure concentricity.

Figure 10:
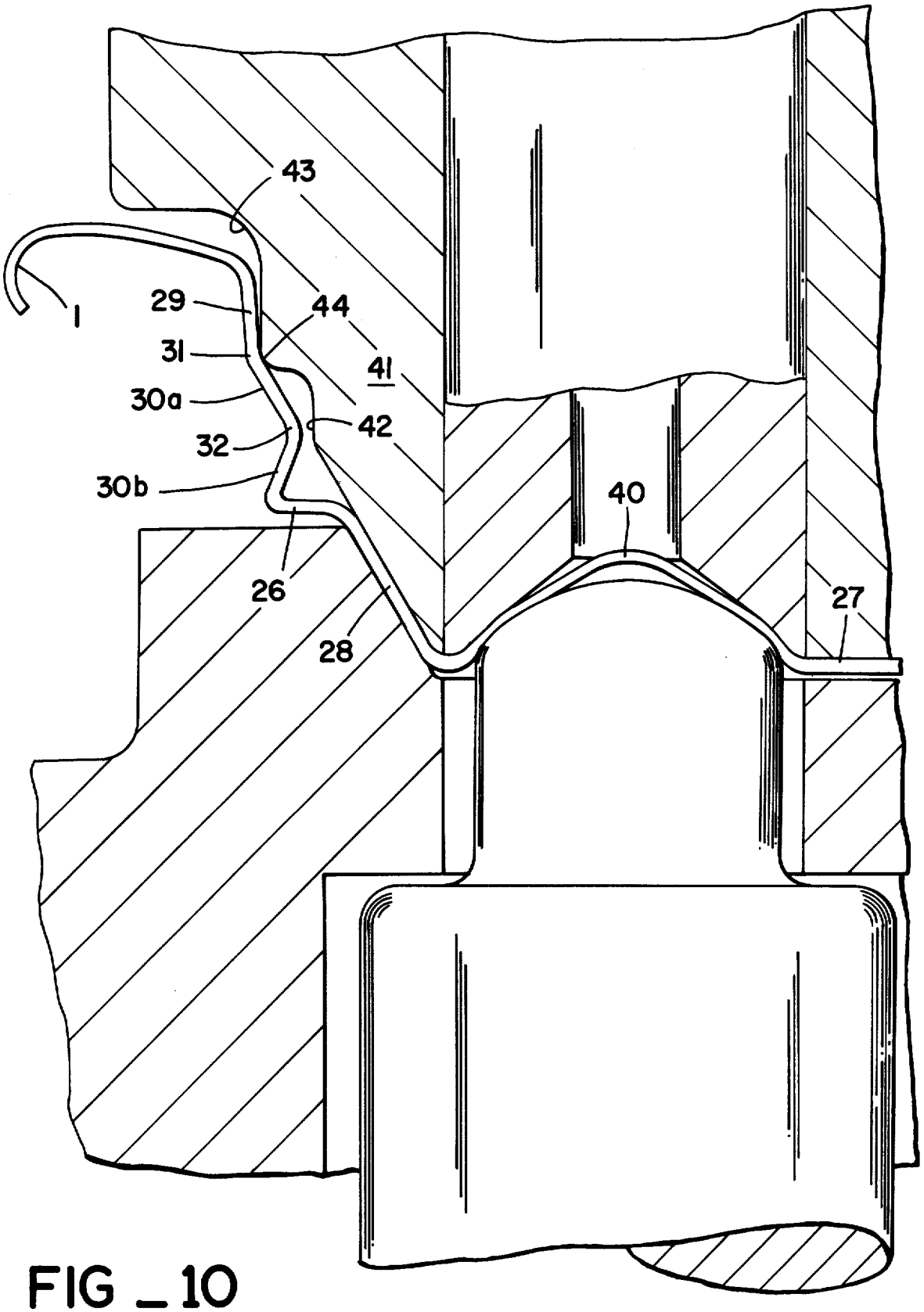
FIG. 10 is a partial sectional view of the container end and tooling in the lifting tab bubble and coining operation with only the tooling cross-hatched.

The further shaped end of FIG. 7 then is passed through forming stages illustrated in FIG. 10–12 which are essentially those disclosed and described in connection with FIGS. 5, 6 and 7 of U.S. Pat. No. 3,765,352. For example, in FIG. 10 a dimple 40 is formed in center section 27 to initiate formation of the rivet 17 which secures the lifting tab 7 to removable panel 10 in the completed container end and the connecting wall 28 is coined to elongate it. Reference is made to FIG. 5 and in its description in U.S. Pat. No. 3,765,352 to illustrate in detail the tooling and its function as shown in FIG. 10 herein. To accomodate the different configuration of the partially formed blank of the improved container end that is shown in FIG. 7, particularly the directional bead 32, wall portions 30a and 30b and locking bend 31, the die 41 is cut away to provide substantial clearance at recesses 42 and 43 and somewhat lesser clearance between the die 41 and locking bend 31 of the blank at 44.

Figure 11:
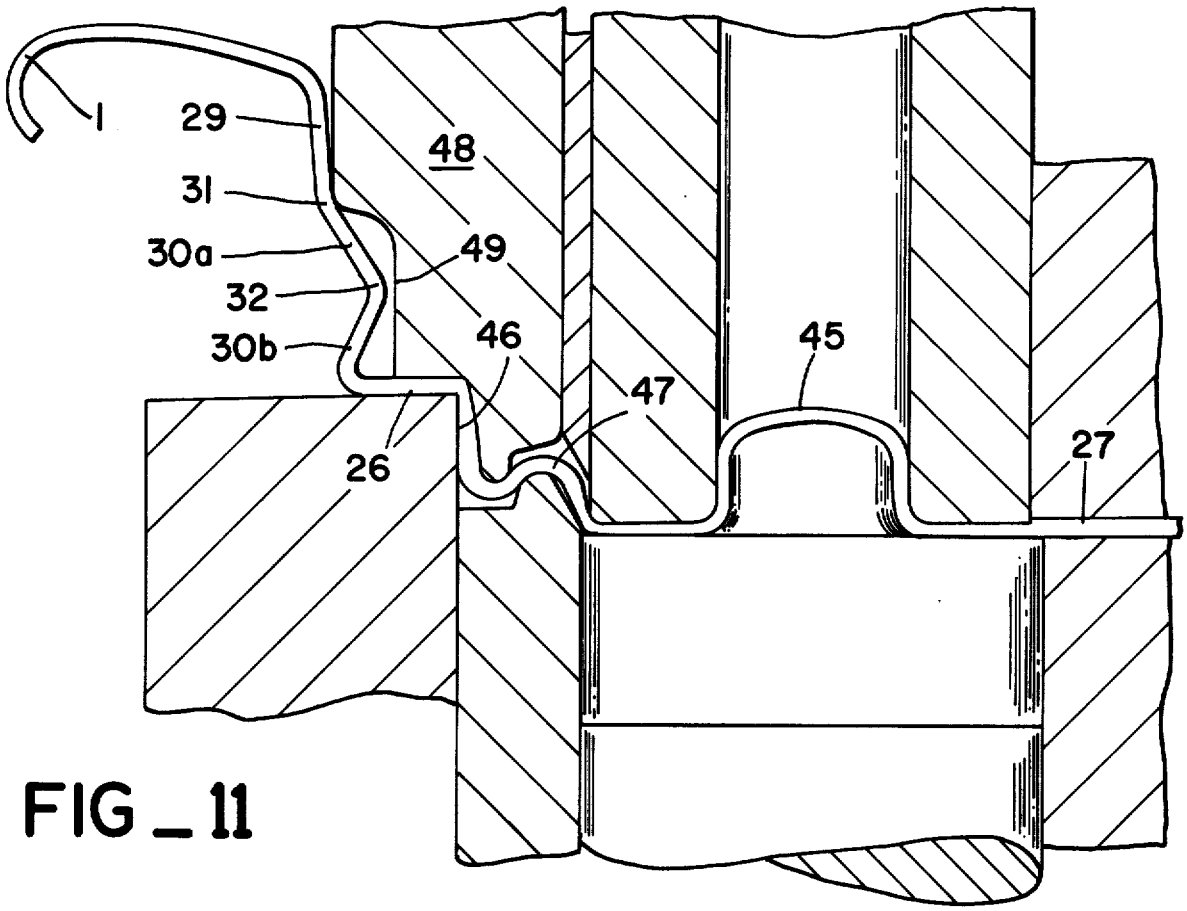
FIG. 11 is a partial sectional view of the container end and tooling of the button and expansion rib forming operation with only the tooling cross-hatched.

In FIG. 11 the dimple 40 is converted into a hollow rivet 45 and the connecting wall 28 is formed into a shorter and more vertical wall section 46 and an expansion rib 47 all as is more particularly disclosed in FIG. 6 and its accompanying description in U.S. Pat. No. 3,765,352 to which reference is made for a full understanding of the procedure and tooling illustrated here in FIG. 11. Again, to accomodate the difference in configuration of the partially formed blank for the container ends of this invention die 48 is cut away at recess 49 to clear locking bend 31, bend 32 and wall portions 30a and 30b.

Figure 12:
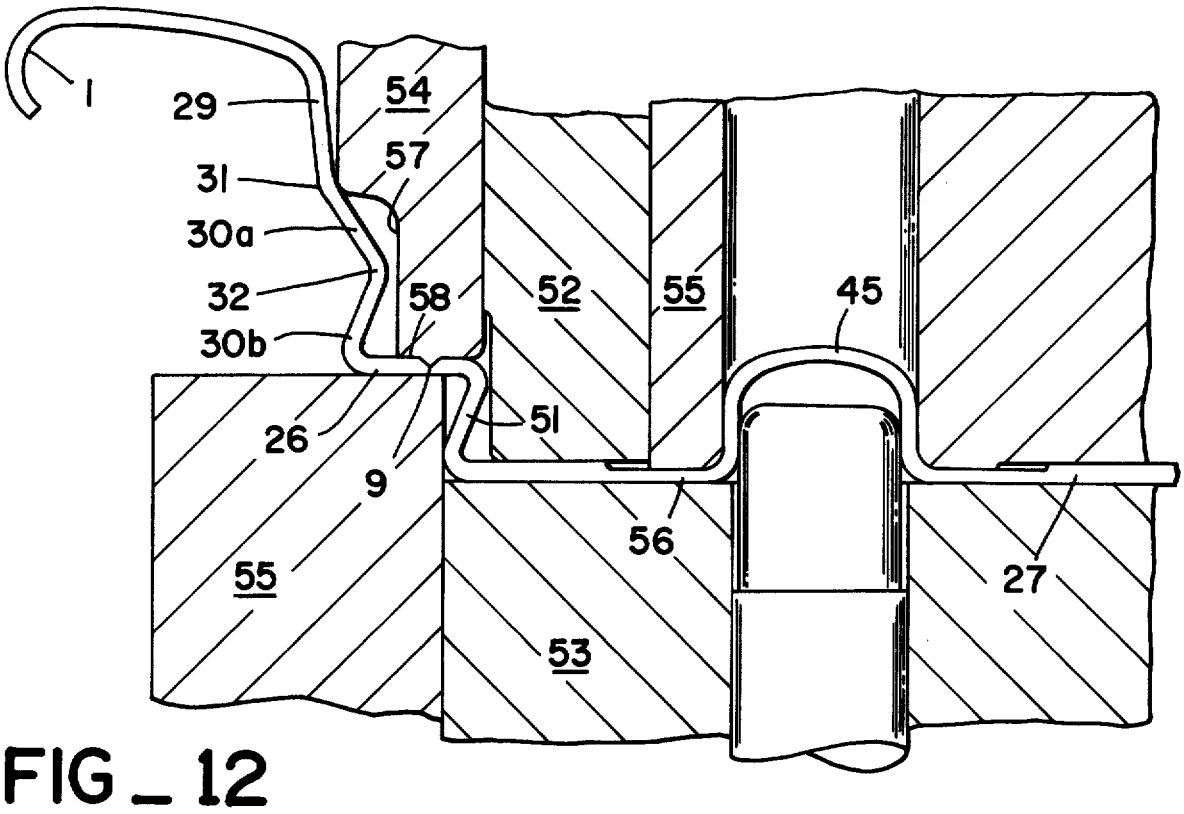
FIG. 12 is a partial sectional view of the scoring and Z-bend forming operation with only the tooling cross-hatched.

Next the tooling in FIG. 12 forms the score line 9 and deforms the expansion rib 47 into a Z bend indicated in FIG. 12 generally as 51. Reference is made in FIG. 7 and the description of the tooling therein disclosed in U.S. Pat. No. 3,765,352 to more particularly describe the operation illustrated in FIG. 12. In essence, in the method shown in FIG. 12 the tool 52 compresses the expansion rib 47 of FIG. 11 against tool 53 thereby expanding the metal outwardly away from hollow rivet 45 with the result that the bottom portion of Z-bend 51 moves radially outwardly with respect to the top portion of the bend which is secured by movement of scoring punch 54 against the radial section 26 of the partially formed end and die 55, thereby, to form score line 9 and at the end of the stroke to coin the portion of radial section 26 just outwardly of the score line at 58. Punch 55 holds the portions 56 of the blank against die 53 so that the metal expansion is radially outwardly into the cavity which forms Z-bend 51. Portions of scoring puch 54 are cut away at recess 57 to accomodate locking bend 31, bead 32 and wall sections 30a and 30b of the partially formed container end of this invention.

Figure 13A:
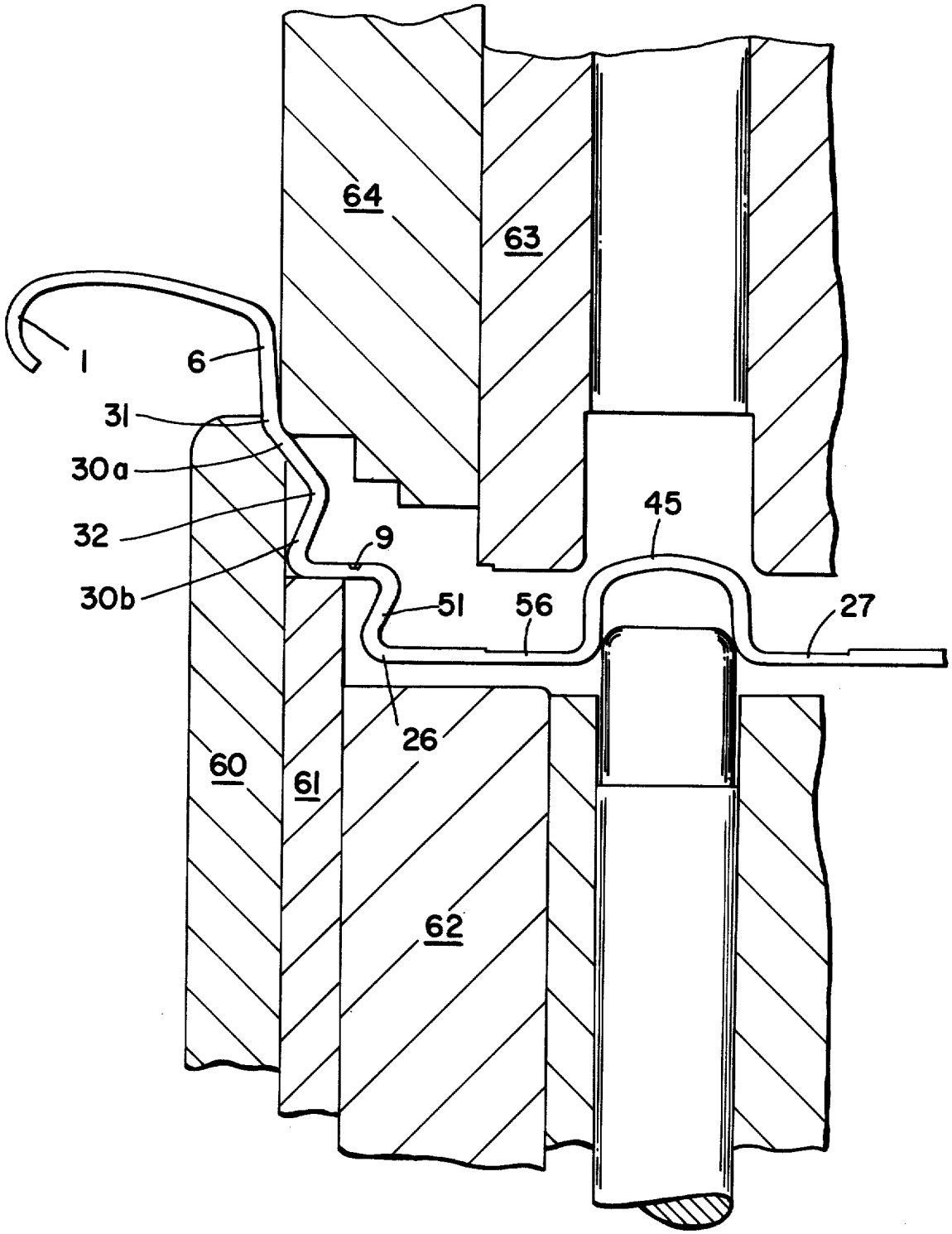
FIGS. 13*a*, 13*b*, and 13*c* are partial sectional views of the sequential steps in the flattening operation for the pair of annular double-reverse folds with only the tooling cross-hatched.
Figure 13B:
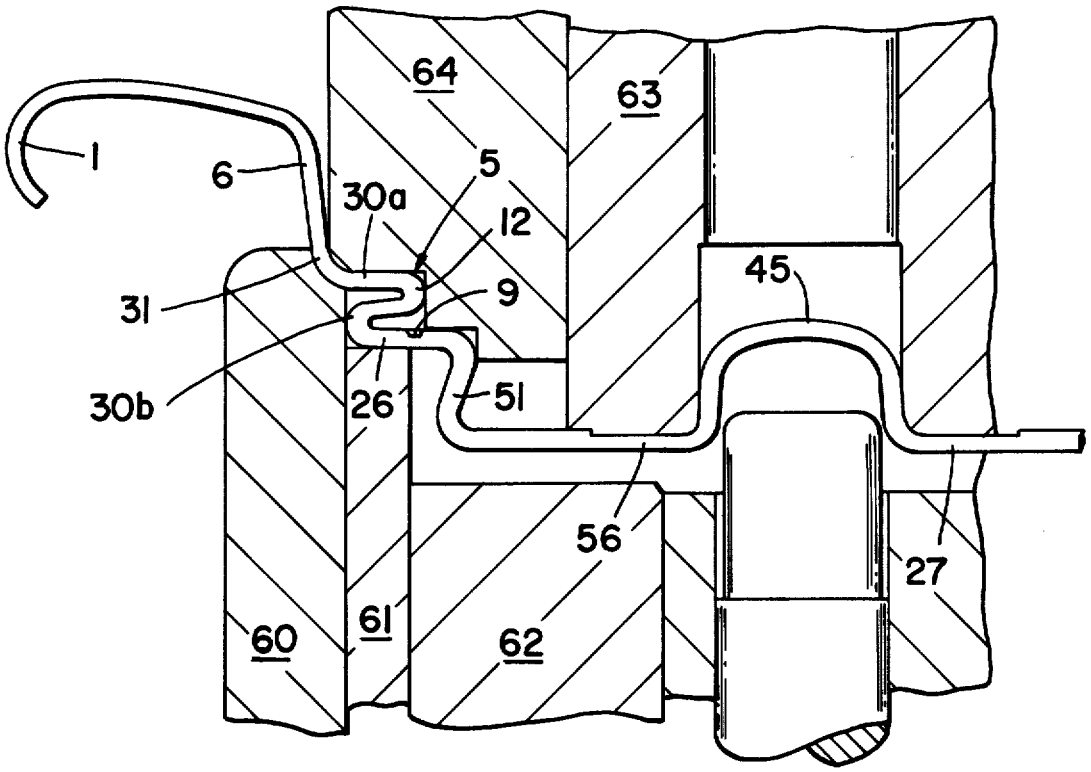
Figure 13C:
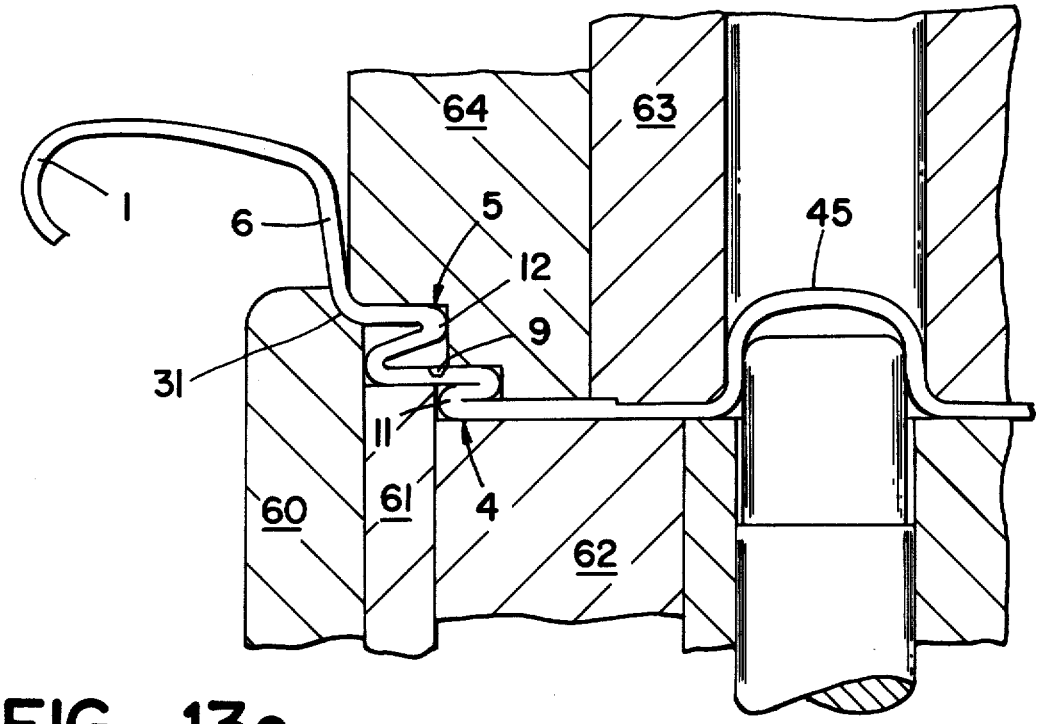
Figure 14:
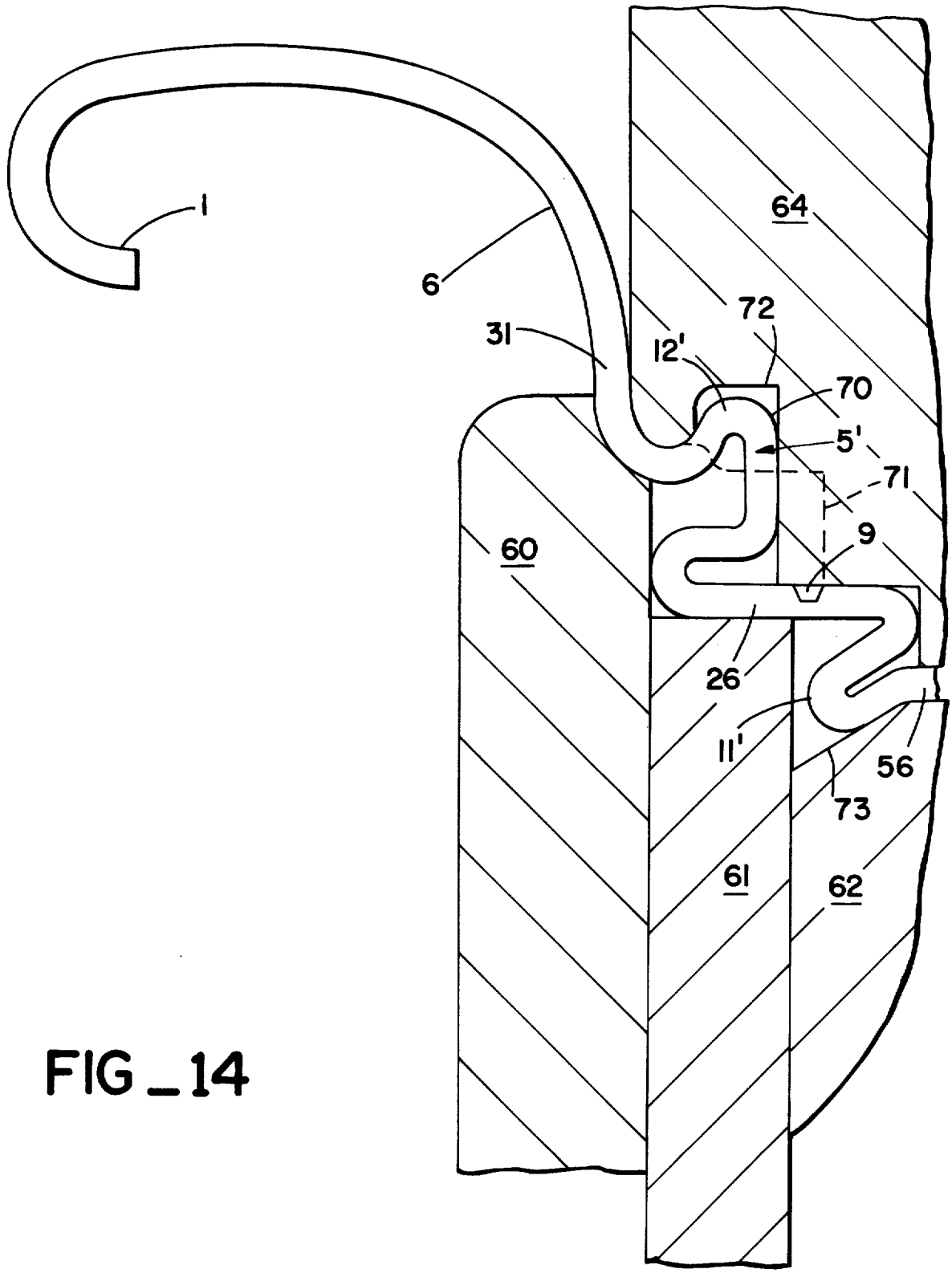
FIG. 14 is a partial sectional view of the container end and tooling for the flattening operation in the region of the lifting tab fracturing nose with only the tooling cross-hatched.

FIGS. 13a and 13c and FIG. 14 illustrate the tooling and procedures for finally forming the end configured as in FIG. 12 into the container end illustrated in FIGS. 1–4. In FIGS. 13a–13c, a three-section punch comprising an outer annular section 60, a mid-section 61 and an inner section 62, all of which move in sequence relative to one another form the final container end configuration against annular die 64 and inner die 63. At the start of their motion shown in FIG. 13a the outer annular section 60 of the punch advances to hold locking bend 31 of the partially formed container end against die 64 to clamp and trap the end material at the locking bend 31. The annular mid-section 61 of the punch then directs walls 30a and 30b and bead 32 against die 64 into the outer double-reverse fold 5 with the bead 32 ultimately forming the protective smooth edge 12 of the fold as is more particularly shown in FIG. 13b. FIG. 13b also illustrates that at the completion of the formation of the outer double-reverse fold 5, portion 56 of the partially formed container end and center section 27 rest upon inner die 63.

To complete the flattening cycle the inner section 62 of the punch engages the center section 27 and portion 56 of the partially formed end against the inner die 63. Then the outer annular die 64 moves relative to the inner die 63 and the former and the inner section 62 of the punch flatten Z-bend 51 into the inner double reverse fold 4 with the smooth edge 11 of the fold underlying score line 9.

During the procedure shown in FIG. 13b for forming the outer double-reverse fold 5 that portion of the outer double-reverse fold 5' in the region of the lifting tab fracturing nose 14 is formed by the modified tooling shown in FIG. 14. There, the vertical wall 70 of the cavity in die 64 that forms the fold is configured outwardly from wall 71 indicated in hidden lines in FIG. 14 that forms the remainder of the outer fold and the cavity has an upward recess 72 to receive the end material as it is flattened outwardly and upwardly to form the modified double-reverse, fold 5' at the lifting tab fracturing nose region. At the fracturing nose the inner section 62 of the punch is bevelled at 73 to form the discontinuity 11' in smooth edge 11 of the inner double-reverse fold.

I claim:

1. A method of making an easy opening container end and comprising steps of providing a piece of sheet material including an annular radial section joined by an annular first connecting section to an axially displaced center section, and a generally curved section joined to said annular radial section by a second annular connecting section;

providing an annular inwardly opening locking bend in said second connecting section;

providing an annular outwardly opening bead in said second connecting section spaced from said locking bend toward said center section;

converting said first connecting section into a generally axial wall and an expansion rib which circumscribes said center section;

forming a score line of weaknesses in said radial section to define a panel at least partially removable from the piece of sheet material;

axially compressing said expansion rib to force the end of said axial wall adjacent said expansion rib radially outwardly to form a Z-bend;

clamping said locking bend;

axially compressing said bead to form an outer double-reverse fold having the compressed bead overlying said score line;

clamping said center section;

axially compressing said Z-bend to form an inner double-reverse fold having the compressed lower bend of said Z-bend underlying said score line.

2. The method of claim 1 further comprising the steps of forming a rivet in the center section for attachment of a lifting tab adjacent to said score line;

flattening said outer double-reverse fold outwardly from said score line and upwardly in the region of said rivet.

* * * * *